US010995488B1

(12) United States Patent
Allard et al.

(10) Patent No.: US 10,995,488 B1
(45) Date of Patent: May 4, 2021

(54) SERVICING ASSEMBLY FOR AN INSULATED STRUCTURE

(71) Applicant: WHIRLPOOL CORPORATION, Benton Harbor, MI (US)

(72) Inventors: Paul B. Allard, Coloma, MI (US); Jeffrey Beckner, Niles, MI (US); Sunil S. Ekshinge, Pune (IN); Abhay Naik, Stevensville, MI (US); Manjunathraddi Navalgund, Pune (IN); Rafael D. Nunes, St. Joseph, MI (US); Sanjesh Kumar Pathak, Stevensville, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 16/689,730

(22) Filed: Nov. 20, 2019

(51) Int. Cl.

| | |
|---|---|
| ***E04B 1/80*** | (2006.01) |
| ***A47L 15/42*** | (2006.01) |
| ***F24C 15/34*** | (2006.01) |
| ***F25D 23/06*** | (2006.01) |

(52) U.S. Cl.
CPC ..... *E04B 1/803* (2013.01); *A47L 15/4209* (2016.11); *F24C 15/34* (2013.01); *F25D 23/063* (2013.01); *F25D 2201/14* (2013.01); *F25D 2700/00* (2013.01)

(58) Field of Classification Search
CPC .... E04B 1/803; F25D 23/063; F25D 2201/14; F25D 2700/00; A47L 15/4209; F24C 15/34
See application file for complete search history.

(56) References Cited

U.S. PATENT DOCUMENTS

| | | | | | |
|---|---|---|---|---|---|
| 2,000,882 | A * | 5/1935 | Comstock | F25D 23/062 | 220/592.26 |
| 4,745,015 | A * | 5/1988 | Cheng | B32B 7/12 | 428/35.8 |
| 5,027,574 | A * | 7/1991 | Phillip | E06B 3/6612 | 52/171.3 |
| 5,318,108 | A * | 6/1994 | Benson | A47J 41/02 | 165/96 |
| 5,345,814 | A * | 9/1994 | Cur | G01M 3/202 | 73/49.3 |
| 5,500,305 | A * | 3/1996 | Bridges | E04B 1/803 | 428/621 |
| 5,695,844 | A * | 12/1997 | Neeser | B23K 33/004 | 428/69 |
| 5,765,379 | A * | 6/1998 | Jensen | F25D 23/062 | 312/401 |
| 5,900,299 | A * | 5/1999 | Wynne | B29C 44/1266 | 156/257 |
| 5,934,085 | A * | 8/1999 | Suzuki | F25D 23/064 | 62/98 |

(Continued)

FOREIGN PATENT DOCUMENTS

WO 2012176880 A1 12/2012

*Primary Examiner* — Hanh V Tran
(74) *Attorney, Agent, or Firm* — Price Heneveld LLP

(57) ABSTRACT

An insulated structure comprises a first panel and a second panel coupled to the first panel. The first and second panels define an insulating cavity therebetween. A port is defined by the second panel. The port is an opening into the insulating cavity. A connector is coupled to the second panel. A tube is coupled to the connector and extends parallel along the second panel.

16 Claims, 11 Drawing Sheets

(56) References Cited

U.S. PATENT DOCUMENTS

| | | | | |
|---|---|---|---|---|
| 6,106,449 | A * | 8/2000 | Wynne | B29C 44/1266 493/101 |
| 6,109,712 | A * | 8/2000 | Haworth | F24C 15/34 312/400 |
| 10,746,343 | B2 * | 8/2020 | Allard | F25D 23/063 |
| 2004/0058119 | A1 * | 3/2004 | Wynne | B32B 5/18 428/69 |
| 2016/0174734 | A1 * | 6/2016 | Artwohl | A47F 3/0434 428/34 |
| 2016/0356637 | A1 * | 12/2016 | Kunapuli | A47F 3/0478 |
| 2017/0167781 | A1 * | 6/2017 | Mukherjee | F25D 23/063 |
| 2019/0145697 | A1 * | 5/2019 | Naik | F25D 23/06 312/400 |
| 2019/0293339 | A1 * | 9/2019 | Gomes | F25D 23/06 |
| 2020/0103067 | A1 * | 4/2020 | Allard | F25D 23/065 |
| 2020/0132243 | A1 * | 4/2020 | Vaze | F16L 59/143 |

* cited by examiner

A method 300 for forming an insulated structure

A method 400 for servicing an insulated structure

SERVICING ASSEMBLY FOR AN INSULATED STRUCTURE

BACKGROUND OF THE DISCLOSURE

The present disclosure generally relates to an insulated structure, and more specifically, to a servicing assembly for an insulated structure.

SUMMARY OF THE DISCLOSURE

According to one aspect of the present disclosure, an insulated structure for an application includes a first panel. A second panel coupled to the first panel. An evacuation port is defined by the second panel. A connector is coupled to the second panel and is disposed over the port. The insulated structure further includes a servicing tube that is coupled to the connector and extends along the second panel. A sensor is coupled to the connector.

According to another aspect of the present disclosure, a vacuum insulated structure for an appliance comprises a liner and a wrapper coupled to the liner to form a structural enclosure. A port is defined by the structural enclosure. A connector defines at least one aperture and is coupled to the wrapper covering the port. A tube coupled to the connector. The tube extends parallel to the structural enclosure.

According to yet another aspect of the present disclosure, an insulated structure comprises a first panel and a second panel coupled to the first panel. The first and second panels define an insulating cavity therebetween. A port is defined by the second panel. The port is an opening into the insulating cavity. A connector is coupled to the second panel. A tube is coupled to the connector and extends parallel along the second panel.

These and other features, advantages, and objects of the present disclosure will be further understood and appreciated by those skilled in the art by reference to the following specification, claims, and appended drawings.

Figure 1:
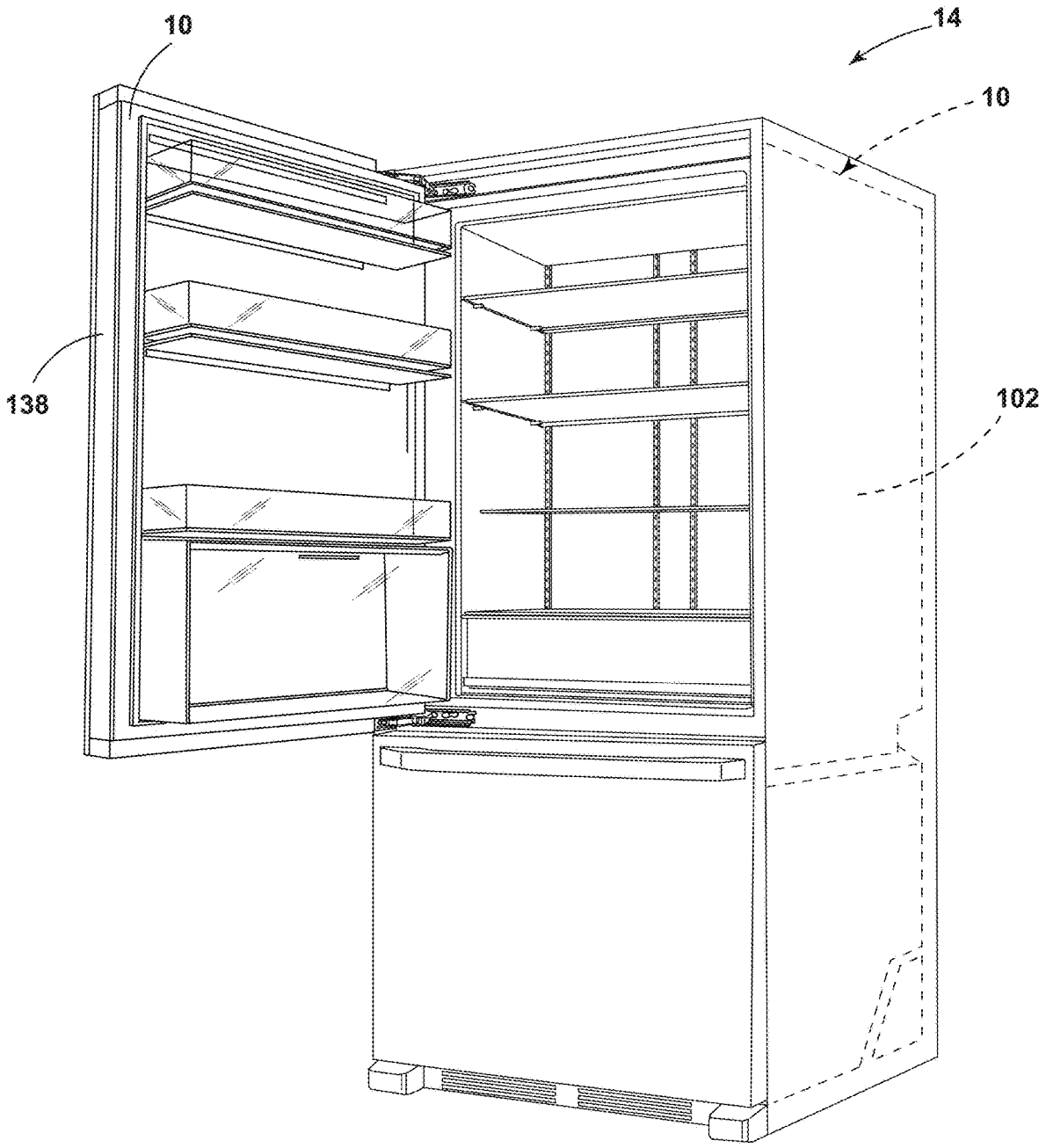
FIG. 1 is a front perspective view of an appliance and an insulated structure in phantom of the present disclosure.

The components in the figures are not necessarily to scale, emphasis instead being placed upon illustrating the principles described herein.

DETAILED DESCRIPTION

The present illustrated embodiments reside primarily in combinations of method steps and apparatus components related to a servicing assembly for an insulated structure. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a . . . " does not, without more constraints, preclude the existence of additional identical elements in the process, method, article, or apparatus that comprises the element.

Referring to FIGS. 1-13, reference numeral 10 generally designates an insulated structure for an appliance 14. The insulated structure 10 includes a first panel 18 and a second panel 22 coupled to the first panel 18. An evacuation port 26 is defined by the second panel 22. A connector 30 is coupled to the second panel 22 and is disposed over the port 26. A servicing tube 34 is coupled to the connector 30 and extends along the second panel 22. In addition, a sensor 38 may be coupled to the connector 30.

Figure 2:
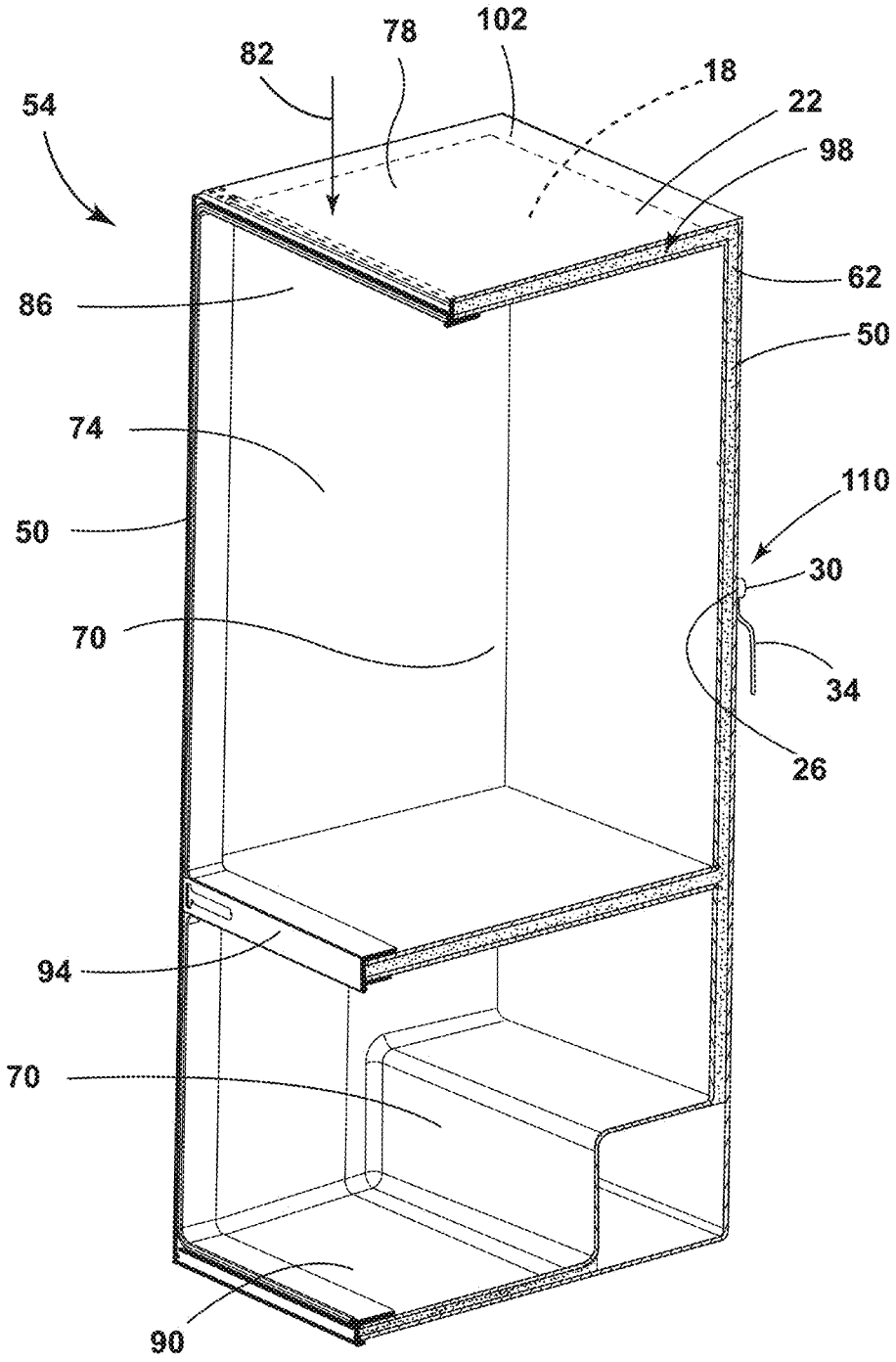
FIG. 2 is a cross-sectional view of a structural enclosure.
Figure 3:
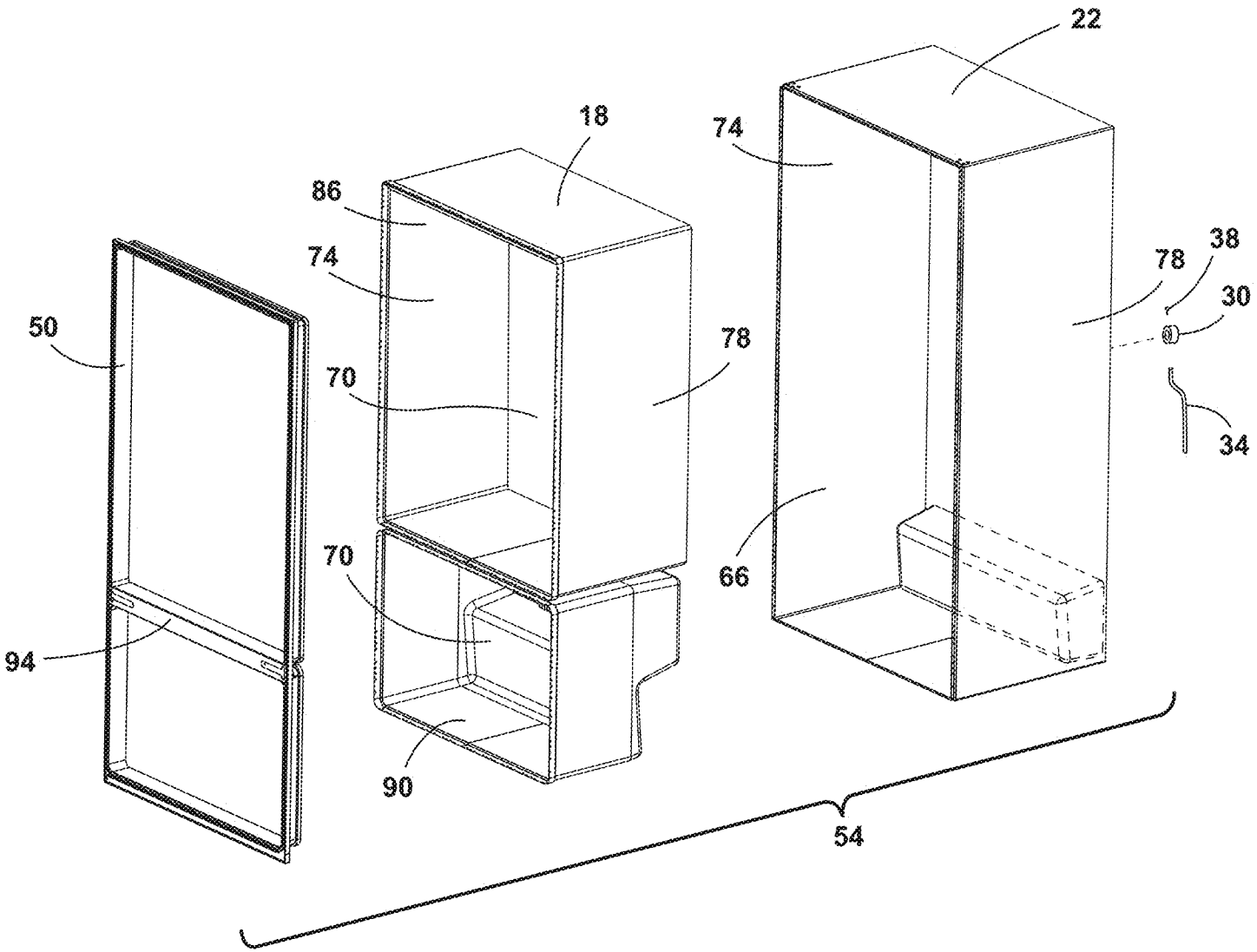
FIG. 3 is an exploded view of the structural enclosure of FIG. 1, with the doors removed.
Figure 4:
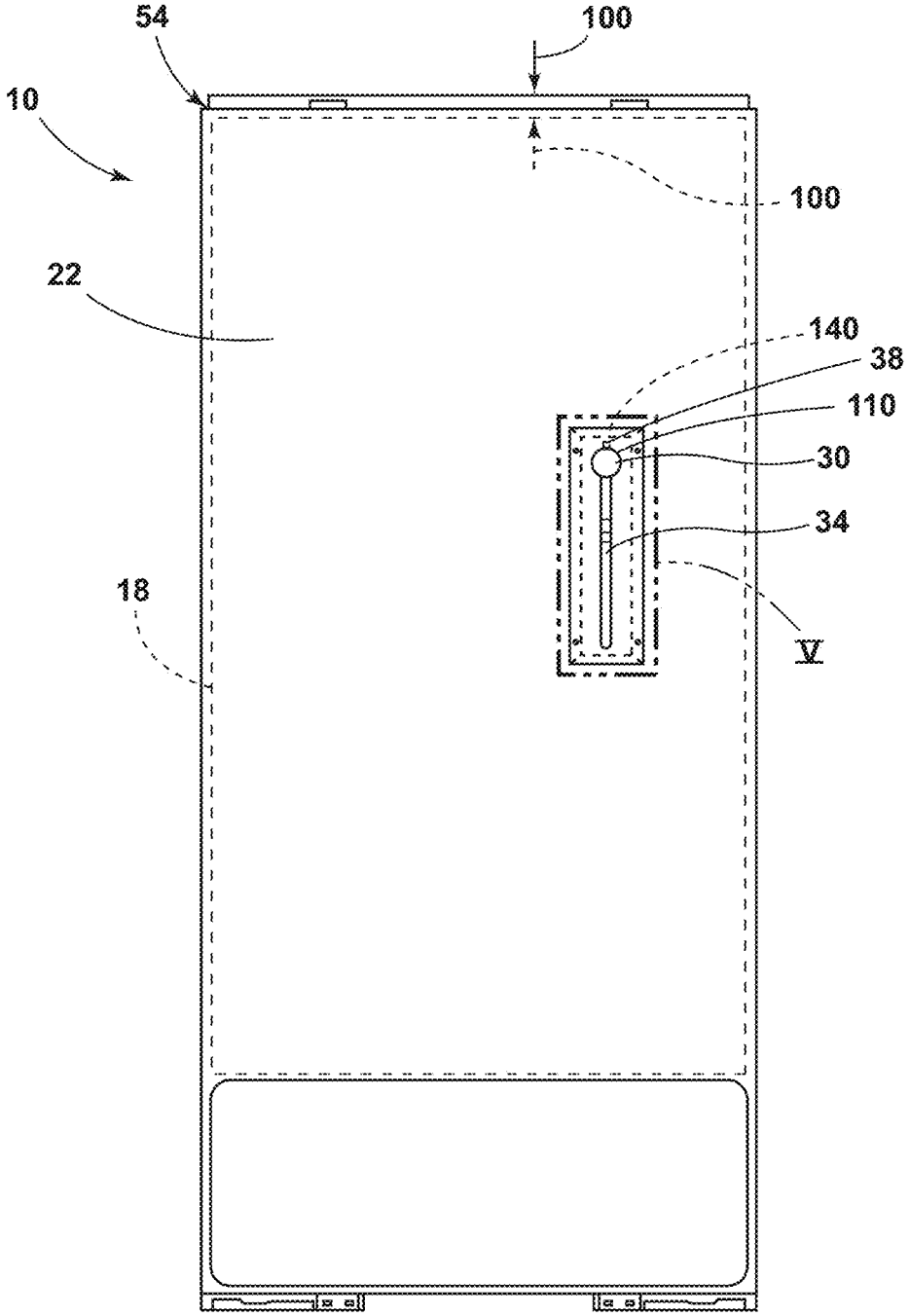
FIG. 4 is a rear elevation view of an insulated structure with a connector and a servicing tube of the present disclosure.
Figure 5:
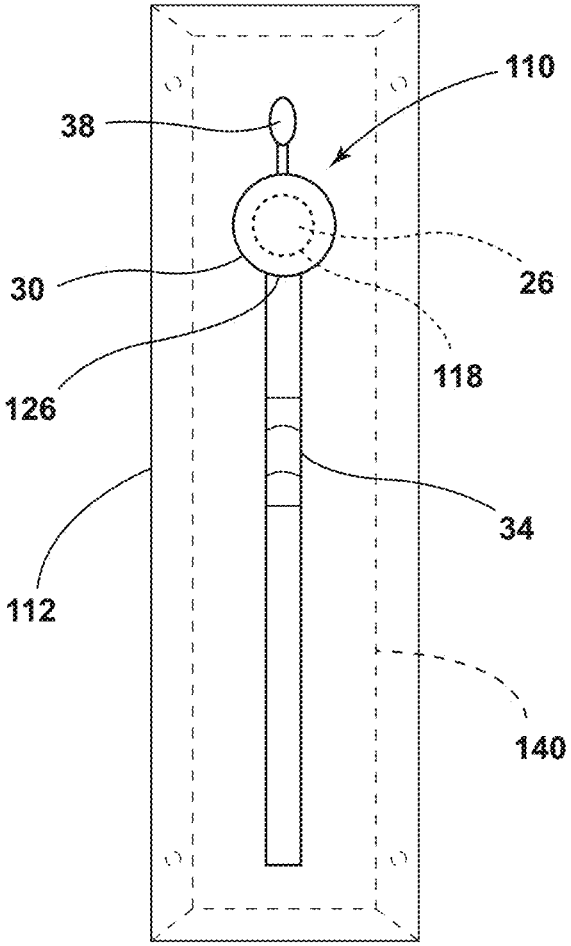
FIG. 5 is an enlarged elevation view of a servicing assembly of FIG. 4 taken at area V.
Figure 6:
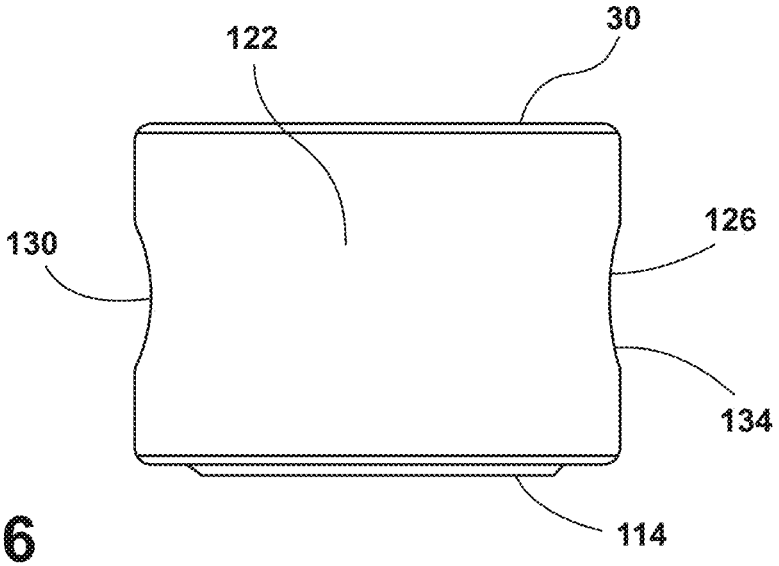
FIG. 6 is a side elevation view of a connector with a base and a body.
Figure 7:
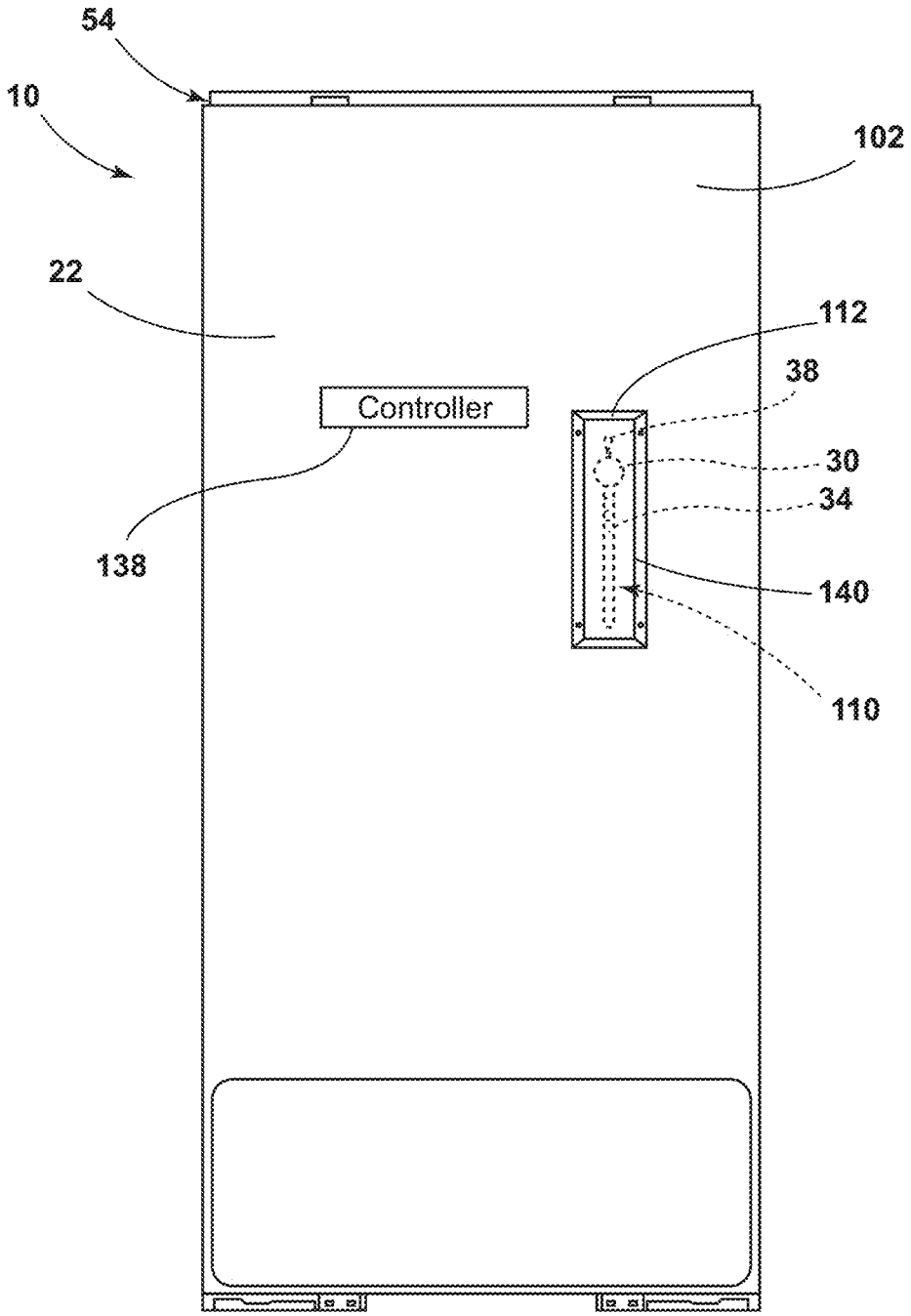
FIG. 7 is a rear elevation view of an insulated structure and structural enclosure with a cap and a servicing assembly in phantom.
Figure 8:
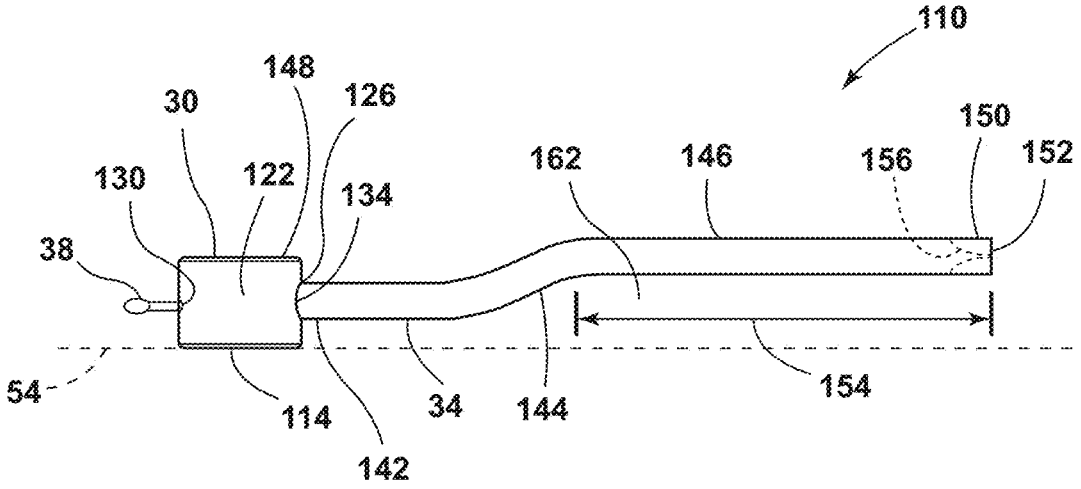
FIG. 8 is a side elevation view an aspect of the servicing assembly defining an initial-use length.
Figure 9:
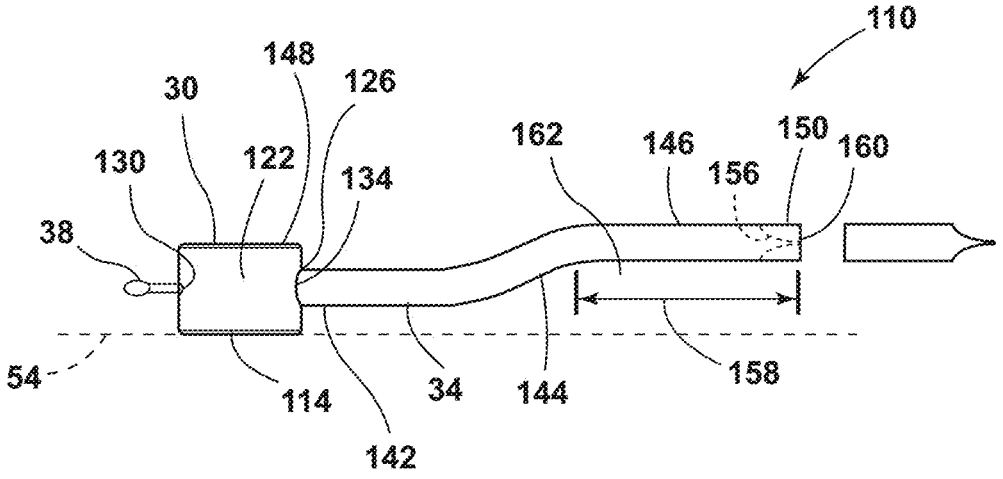
FIG. 9 is a side view of the servicing assembly of FIG. 8 defining a reuse length.
Figure 10:
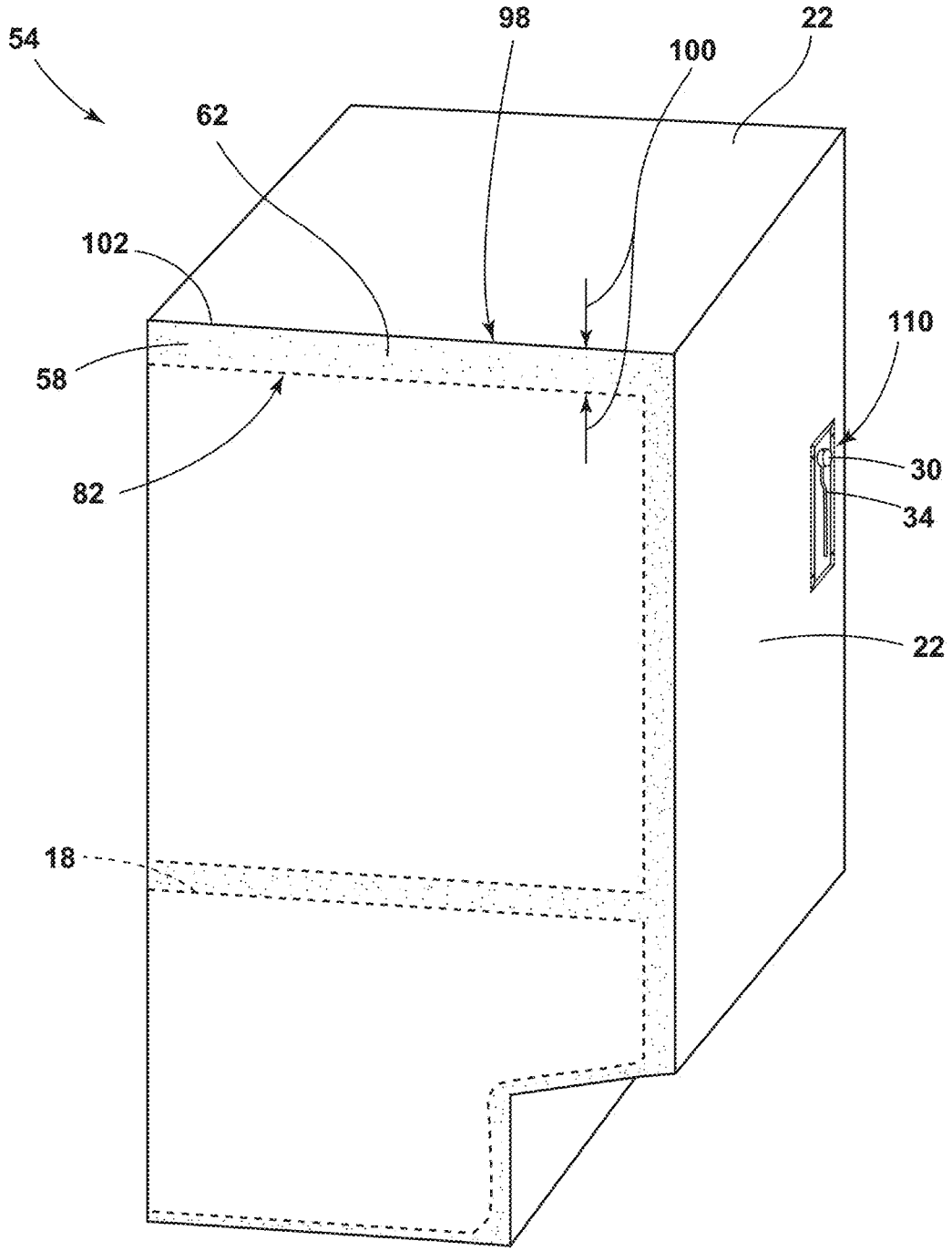
FIG. 10 is a cross-sectional side perspective view of an insulated structure with an insulating cavity and insulation materials.
Figure 11:
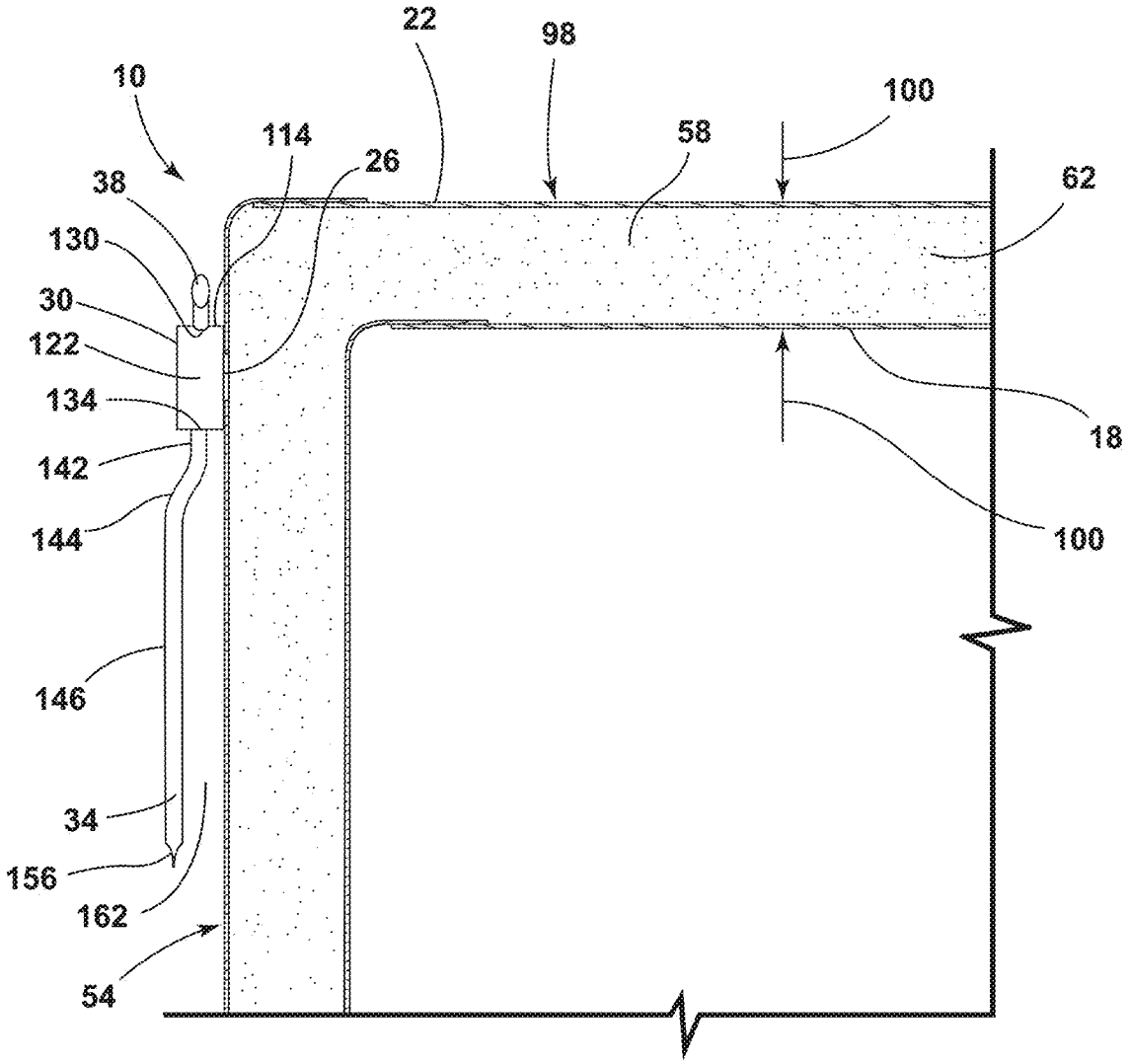
FIG. 11 is a partial cross-sectional view of an insulated structure with a servicing assembly.
Figure 12:
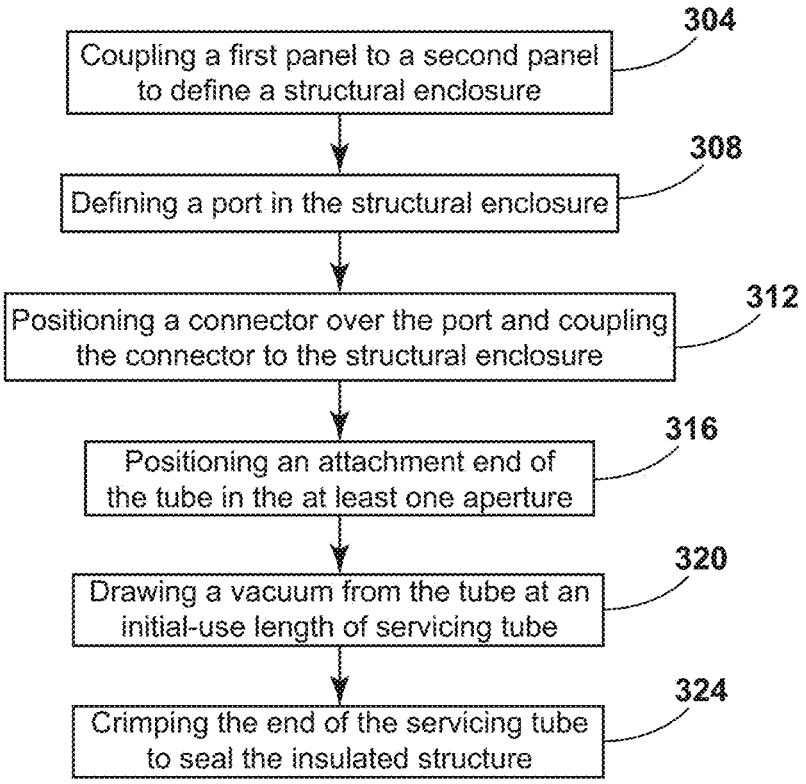
FIG. 12 is a flow diagram for a method for forming an insulated structure of the present disclosure.
Figure 13:
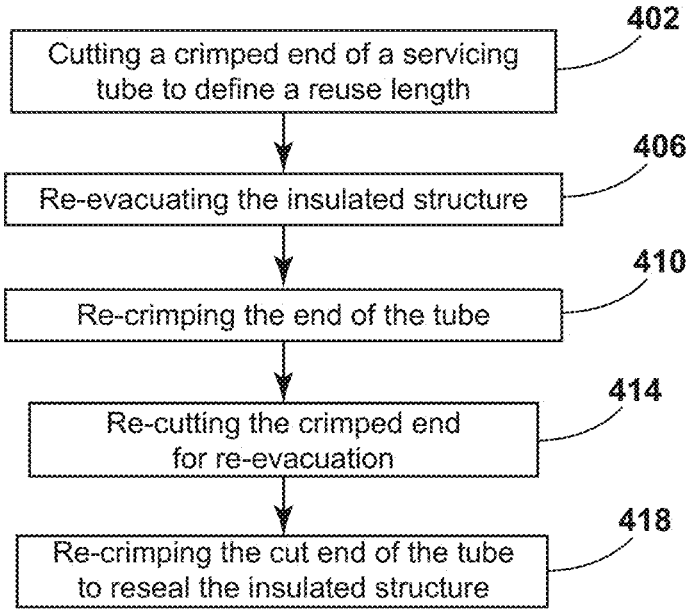
FIG. 13 is a flow diagram for a method for servicing an insulated structure of the present disclosure.

Referring to FIGS. 1-3, the appliance 14 is illustrated as a refrigerating appliance, but it is also contemplated that the insulated structure 10 described herein may be used with a variety of appliances or insulation purposes other than within an appliance. Moreover, the insulated structure 10 may be in the form of a vacuum insulated structural cabinet, as illustrated, or a vacuum insulated panel that may be used as an insulation member for the appliance 14. According to various examples, the insulated structure 10 includes the first panel 18 and the second panel 22, which may alternatively be referred to as a liner 18 and a wrapper 22, respectively. The wrapper 22 and the liner 18 are coupled to a trim breaker 50 to generally define a structural enclosure 54, which further defines an insulating cavity 58 in which one or more insulation materials 62 may be disposed. It is generally contemplated that the insulation materials 62 may be a glass-type material, a carbon-based powder, silicon oxide-based materials, insulating gasses, and other standard insulation materials 62 known in the art. The insulation materials 62 substantially fill the insulating cavity 58 forming a substantially continuous layer between the liner 18 and the wrapper 22.

In the depicted insulated structure 10, the wrapper 22 has a three-dimensional shape such that a plurality of panels define a central cavity 66. Correspondingly and as depicted, the liner 18 has a plurality of surfaces defining an inner cavity 70. It is generally contemplated that the liner 18 is received within the central cavity 66 of the wrapper 22, thus at least partially defining the insulating cavity 58. The liner 18 may be constructed to define a first compartment 86 and a second compartment 90 defined by the trim breaker 50 and separated by a mullion 94. Additionally, the wrapper 22 and the liner 18 include inner surfaces 74 and outer surfaces 78 and may be made from a material at least partially resistant to bending, biasing, or otherwise being formed in response to an inward compressive force 82. These materials for the liner 18 and the wrapper 22 may include, but are not limited to, metals, polymers, metal alloys, combinations thereof, and other similar substantially rigid materials that can be used for vacuum insulated structures within appliances.

In addition, an at least partial vacuum 98 is defined within the insulating cavity 58, where the at least partial vacuum 98 defines a pressure differential 100 between an exterior 102 of the insulated structure 10 and the insulating cavity 58. This pressure differential 100 serves to define the inward compressive force 82 that is exerted upon both the wrapper 22 and the liner 18 and tends to bias the wrapper 22 and the liner 18 toward the insulating cavity 58 of the insulated structure 10. Over time, gas can infiltrate into the insulating cavity 58 from an area outside of the appliance 14, which can diminish the at least partial vacuum 98. This infiltration of gas is sometimes referred to as gas permeation. As a result of the gas permeation, the at least partial vacuum 98 will slowly decrease over time.

Referring to FIGS. 4-7, a servicing assembly 110 is coupled to the structural enclosure 54 on either the liner 18 or the wrapper 22 and may be used to counter potential gas permeation. It is generally contemplated that the servicing assembly 110 may be coupled to a fastening surface 112 of the structural enclosure 54, described in more detail below. The at least partial vacuum 98 may be defined by evacuation of the insulated structure 10 through the port 26, which is an opening into the insulating cavity 58, via the servicing assembly 110. The servicing assembly 110 includes, at least, the connector 30, the servicing tube 34. The servicing assembly 110 may also include the port 26, such that the connector 30 is disposed over the port 26 with the servicing tube 34 extending generally parallel along the structural enclosure 54. The connector 30 is constructed to be larger than the port 26, such that the connector 30 covers the port 26. It is also contemplated that the connector 30 generally aligns with the port 26, such that a base 114 of the connector 30 is disposed along a rim 118 defining the port 26. The connector 30 is coupled to the structural enclosure 54 by various mechanisms and methods that can involve, but are not limited to, projection welding, resistance welding, adhering, or other coupling methods typically used with vacuum insulated structures. When the connector 30 is coupled to the wrapper 22 or liner 18 by projection welding, the weld is typically localized to the base 114 of the connector 30, such that energy applied for forming the weld is directed at the base 114 of the connector 30 as compared to a body 122 of the connector 30.

The connector 30 may be generally cylindrical and the body 122 defines at least one aperture 126 in which the servicing tube 34 is positioned. The connector 30 may also be generally rectangular, triangular, or any other shape suitable for covering the port 26 and coupling to the structural enclosure 54. The connector 30 is generally parallel with the structural enclosure 54, such that the connector 30 minimally protrudes from the structural enclosure 54 when coupled. In addition, the body 122 of the connector 30 may define a first aperture 130 and a second aperture 134 that are generally normal relative to the structural enclosure 54. The sensor 38 may be coupled with the connector 30 at the first aperture 130 and the servicing tube 34 may be coupled with the connector 30 at the second aperture 134, such that the sensor 38 and the servicing tube 34 may outwardly extend from the first and second apertures 130, 134, respectively, parallel with the structural enclosure 54. The first aperture 130 may be of a similar size as the second aperture 134 or may be generally larger or smaller than the second aperture 134 depending on the size of the sensor 38. As the sensor 38 and the servicing tube 34 extend generally parallel along the structural enclosure 54, it is contemplated that the connector 30, the tube 34, and the sensor 38 may all be generally parallel relative to the structural enclosure 54. It is also contemplated that the sensor 38 may be positioned within the connector 30 or within the structural enclosure 54, such that the sensor 38 may be disposed within the insulating cavity 58 (FIG. 2).

The sensor 38 is configured to monitor the internal pressure of the insulated structure 10 and detect a pressure change within the insulated structure 10. By way of example, and not limitation, the sensor 38 may send a signal to a controller 136 indicating that the pressure differential 100 defined between the exterior 102 and the insulating cavity 58 of the insulated structure 10 has decreased. The controller 136 may be positioned in any practicable location in the appliance 14 (FIG. 1), such as in a user interface generally positioned on a door 138 of the appliance 14 (FIG. 1). Additionally, the controller 136 may have a memory and a processor to assess the signal from the sensor 38 and compare the signal to stored data within the memory.

A decrease in the pressure differential 100 may correspond to the at least partial vacuum 98 being lessened within the insulated structure 10 in a manner indicative of gas permeation into the insulating cavity 58. Accordingly, over time, and without additional servicing, the pressure differential 100 will ultimately equalize between the exterior 102 and the insulating cavity 58. This occurrence can significantly minimize the insulating capability of the insulated structure 10. The controller 136, upon receiving the signal indicating a decrease in pressure, may notify a user that servicing of the insulated structure 10 may be desired. To combat the loss of the at least partial vacuum 98, the servicing tube 34 is coupled to the connector 30 for repeatedly servicing the insulated structure 10 via the servicing assembly 110.

Referring to FIGS. 1 and 7-9, the servicing assembly 110 is coupled to the structural enclosure 54 and may be selectively covered by a cap 140. The cap 140 may be formed from a metal, a plastic, or any other material suitable for detachment and reattachment to the structural enclosure 54. By way of example, and not limitation, the cap 140 may be removably coupled to the fastening surface 112 of the structural enclosure 54. The cap 140 may snap, clip, or otherwise coupled to the fastening surface 112, such that the cap 140 is generally a similar size and construction as the fastening surface 112. Accordingly, the servicing assembly 110 may remain selectively accessible by removing the cap 140 even after the insulated structure 10 is integrated with the appliance 14, such that the cap 140 may be generally visible and accessible after the appliance 14 is assembled. It is contemplated that the cap 140 may be constructed to be aesthetically integrated with the appliance 14 while maintaining selective removal for servicing of the insulated structure 10. The cap 140 and the servicing assembly 110 are generally planar with the appliance 14, such that the cap 140 may appear integrated and flush with the appliance 14. Additionally, the servicing assembly 110 and the cap 140 may be positioned in any practicable location on the insulated structure 10 so long as the servicing assembly 110 may be accessed to service the insulated structure 10.

The cap 140 may be constructed to accommodate the varying size of the servicing assembly 110 depending on the features included in the servicing assembly 110. By way of example, and not limitation, the cap 140 may be longer when the sensor 38 is positioned within the first aperture 130 of the connector 30. Additionally or alternatively, the cap 140 may be shorter when the servicing assembly 110 only includes the servicing tube 34 and the connector 30 positioned exterior to the structural enclosure 54. It is generally contemplated that the cap 140 may be constructed in various shapes and sizes to selectively cover any external features of the servicing assembly 110 relative to the structural enclosure 54. The cap 140 may be removed from the insulated structure 10 and the appliance 14 when the sensor 38 communicates to the controller 136 that servicing of the insulated structure 10 may be desired. Once servicing is complete, the cap 140 may be reattached to the insulated structure 10.

Referring to FIGS. 8-11, the servicing tube 34 defines an attachment end 142, a stepped portion 144, and a repeated-use maintenance portion 146. The attachment end 142 is positioned within the aperture 126 of the connector 30 proximate to the structural enclosure 54. The attachment end 142 of the servicing tube 34 is configured to couple the servicing tube 34 to the connector 30, and it is contemplated that the attachment end 142 may be a shorter length than the repeated-use maintenance portion 146. The stepped portion 144 is defined between the attachment end 142 and the repeated-use maintenance portion 146. As illustrated, the stepped portion 144 is angled and is generally of a shape, such that the stepped portion 144 raises the repeated-use maintenance portion 146 away from the structural enclosure 54. The servicing tube 34 is typically formed from a metal material or that is generally rigid while still being capable of compression, such as crimping. Unlike conventional tubing, the servicing tube 34 remains generally parallel with the structural enclosure 54 during servicing sessions of the insulated structure 10. Stated differently, there is a close engagement between the servicing tube 34 and the structural enclosure 54, such that the repeated-use maintenance portion 146 is generally even with an outer portion 148 of the connector 30. The servicing tube 34 is configured to be repeatedly serviced, such that an end 150 of the servicing tube 34 may be cut or otherwise severed and resealed. Although the end 150 may be cut and resealed, the repeated-use maintenance portion 146, is configured to remain generally parallel to the structural enclosure 54, such that the servicing tube 34 is not bent away from the structural enclosure 54 during the servicing sessions.

The insulated structure 10 is generally formed using vacuum insulation technology. The port 26 provides access to the insulating cavity 58 in which the pressure differential 100 may be defined after the at least partial vacuum 98 is drawn. A vacuum device is positioned around the end 150 of the servicing tube 34 and draws the at least partial vacuum 98 through a first access opening 152 of the repeated-use maintenance portion 146. Once the desired pressure differential 100 is defined between the insulating cavity 58 and the liner 18 and wrapper 22 of the insulated structure 10, the first access opening 152 is crimped to seal the servicing assembly 110 and, ultimately, the insulated structure 10. Accordingly, an initial-use length 154 of the repeated-use maintenance portion 146 is defined between a crimped end 156 and the stepped portion 144 of the servicing tube 34. The initial-use length 154 is further defined as the length of the servicing tube 34 remaining after the initial evacuation of the insulating cavity 58 that results in the at least partial vacuum 98. Stated differently, the initial-use length 154 is defined as the length of the servicing tube 34 after the initial formation of the insulated structure 10. In an exemplary and non-limiting aspect of the device, the initial-use length 154 is at least long enough to accommodate three servicing sessions of the insulated structure 10.

Over time, the at least partial vacuum 98 may begin to dissipate due to gas permeation into the insulated structure 10. Accordingly, the sensor 38 will sense a decrease in pressure within the insulating cavity 58. The sensor 38 may then send a signal to the controller 136 indicating that it may be desirable to service the insulated structure 10. A service technician may then remove the cap 140 from the appliance 14 to access the servicing assembly 110. The crimped end 156 of the servicing tube 34 may be cut to define a reuse length 158 and a second access opening 160. The at least partial vacuum 98 may be redrawn through the second access opening 160 to the desired pressure differential 100. Once re-evacuated, the end 150 may be crimped to redefine the crimped end 156 of the servicing tube 34. After the first servicing, the reuse length 158 of the repeated-use maintenance portion 146 is now the length of the servicing tube 34 between the stepped portion 144 and the crimped end 156. The servicing tube 34 is accordingly shorter as a result of the servicing of the insulated structure 10, such that the reuse length 158 is shorter than the initial-use length 154. The reuse length 158 may be defined at any point along the repeated-use maintenance portion 146 that is less than the initial-use length 154. The reuse length 158 is also contemplated to be sufficiently long to accommodate multiple servicing sessions to repeatedly maintain the at least partial vacuum 98 defined within the insulating cavity 58. In a non-limiting example, the initial-use length 154 may be sufficient to provide three servicing sessions.

In addition, a unique servicing space 162 is defined between the structural enclosure 54 and the stepped and repeated-use maintenance portions 144, 146. The unique servicing space 162 provides a gap between the repeated-use maintenance portion 146 and the structural enclosure 54 to make the servicing sessions of the insulated structure 10 more efficient. Accordingly, the unique servicing space 162 provides sufficient space within which a tool may be positioned to cut the end 150 of the repeated-use maintenance portion 146 and reseal the crimped end 156 of the repeated-used maintenance portion 146 with minimal disruption of the servicing tube 34 relative to the structural enclosure 54.

As mentioned above, the servicing tube 34 may remain generally parallel with the structural enclosure 54 during the servicing sessions, aided by the unique servicing space 162.

Without the unique servicing space 162, a conventional servicing pipe would be repeatedly bent or manipulated to accommodate a servicing tool. This manipulation may otherwise compromise the integrity of the servicing pipe.

As a result of the unique servicing space 162, the servicing tube 34 may be formed from a generally rigid material that strengthens the overall integrity of the servicing assembly 110 by, ultimately, minimizing potential wear and tear that may otherwise occur. The unique servicing space 162 is also sufficiently shallow so the servicing assembly 110 minimally protrudes from the structural enclosure 54, such that the servicing assembly 110 is generally parallel with the structural enclosure 54.

Referring to FIGS. 1-13, a method 300 for forming an insulated structure 10 includes coupling a first panel 18 to a second panel 22 to define a structural enclosure 54 (step 304) and defining a port 26 in the structural enclosure 54 (step 308). A connector 30 is positioned over the port 26 and coupled to the structural enclosure 54 (step 312). The connector 30 may define at least one aperture 126 in which a tube 34 may be positioned. Additionally or alternatively, the connector 30 may define a first aperture 130 and a second aperture 134 in which a sensor 38 and the tube 34 are respectively positioned. More specifically, an attachment end 142 of the tube 34 may be positioned in the at least one aperture 126, such that a stepped portion 144 and a repeated-use maintenance portion 146 outwardly extends from the connector 30 parallel to the structural enclosure 54 (step 316). An at least partial vacuum 98 is drawn from an initial-use length 154 defined by the repeated-use maintenance portion 146 and configured to be shortened over time as a result of servicing the insulated structure 10 (step 320). Finally, the insulated structure 10 is sealed by crimping the end 150 of the servicing tube 34 (step 324).

A method 400 for servicing the insulated structure 10 includes cutting a crimped end 156 of the repeated-use maintenance portion 146 to define a reuse length 158, which is capable of being repeatedly altered during the servicing of the insulated structure 10 (step 402). Over time, the pressure differential 100 between the exterior 102 and the insulating cavity 58 may start to equalize resulting in a decrease in the at least partial vacuum 98. Accordingly, the crimped end 156 of the servicing tube 34 is capable of being cut so as to re-evacuate the insulated structure 10 to maintain the at least partial vacuum 98 within the insulated structure 10 (step 406). The end 150 of the servicing tube 34 can then be crimped to define the reuse length 158 of the tube 34 after re-evacuation of the insulated structure 10 (step 410). This process can be repeated, such that the crimped end 156 can be recut for re-evacuating the insulated structure 10 (step 414), and the end 150 can then be re-crimped after the servicing session to reseal the insulated structure 10 (step 418).

This process may be repeated multiple times, such that the reuse length 158 may be repeatedly cut and the end 150 of the servicing tube 34 may be repeatedly resealed. Thus, the servicing assembly 110 minimizes replacement cost and increases the overall longevity of the insulated structure 10. In turn, a user may use the insulated structure 10 and overall appliance 14 for a longer period than may be possible with conventional appliances and conventional insulated structures that do not include the servicing assembly 110 described herein.

According to the various examples, the insulated structure 10 can be used in various appliances that can include, but are not limited to, refrigerators, freezers, coolers, ovens, dishwashers, laundry appliances, water heaters, and other similar appliances and fixtures within household and commercial settings. Additionally, the insulation materials 62 can be a free-flowing material that can be poured, blown, compacted or otherwise disposed within the insulating cavity 58. This free-flowing material can be in the form of various silica-based materials, such as fumed silica, precipitated silica, nano-sized and/or micro-sided aerogel powder, rice husk ash powder, perlite, glass spheres, hollow glass spheres, cenospheres, diatomaceous earth, combinations thereof, and other similar insulating particulate material.

The invention disclosed herein is further summarized in the following paragraphs and is further characterized by combinations of any and all of the various aspects described therein.

According to one aspect of the present disclosure, an insulated structure for an application includes a first panel. A second panel coupled to the first panel. An evacuation port is defined by the second panel. A connector is coupled to the second panel and is disposed over the port. The insulated structure further includes a servicing tube that is coupled to the connector and extends along the second panel. A sensor is coupled to the connector.

According to another aspect, an insulated structure includes a sensor that outwardly extends from a connector and is parallel with a second panel.

According to yet another aspect, a sensor is a pressure sensor and is configured to monitor the internal pressure of an insulated structure.

According to still another aspect, a connector, a port, and a servicing tube define a servicing assembly. The servicing assembly is selectively covered by a cap.

According to another aspect, an attachment end is coupled to a connector that is adjacent to a second panel. A maintenance portion extends from a stepped portion that is parallel to the second panel and defines a unique space.

According to yet another aspect, a connector is cylindrical and defines an aperture. A servicing tube is positioned within the aperture. The connector defines a base. The base is coupled to a second panel and is covering a port.

According to another aspect of the present disclosure, a vacuum insulated structure for an appliance comprises a liner and a wrapper coupled to the liner to form a structural enclosure. A port is defined by the structural enclosure. A connector defines at least one aperture and is coupled to the wrapper covering the port. A tube coupled to the connector. The tube extends parallel to the structural enclosure.

According to another aspect, a sensor is configured to detect a pressure change within a structural enclosure.

According to yet another aspect, at least one aperture includes a first aperture and a second aperture. A sensor is disposed within the first aperture and a tube is positioned within the second aperture.

According to still another aspect, a connector and a tube define a servicing assembly of a vacuum insulated structure.

According to another aspect, a cap is coupled to a structural enclosure. A servicing assembly is selectively covered by the cap.

According to yet another aspect, a tube includes a repeated-use maintenance portion.

According to still another aspect, a repeated-use maintenance portion defines an initial-use length and a reuse length. The initial-use length is longer than the reuse length.

According to yet another aspect of the present disclosure, an insulated structure comprises a first panel and a second panel coupled to the first panel. The first and second panels define an insulating cavity therebetween. A port is defined by the second panel. The port is an opening into the insulating cavity. A connector is coupled to the second panel. A tube is coupled to the connector and extends parallel along the second panel.

According to another aspect, a port, a connector, and a tube define a servicing assembly for an insulated structure. A cap selectively covers the servicing assembly.

According to yet another aspect, a tube includes an attachment end, a repeated-use maintenance portion, and a stepped portion therebetween. The stepped portion and the repeated-use maintenance portion defines a unique space relative to a second panel.

According to still another aspect, a tube includes a repeated-use maintenance portion for repeatedly sealing and unsealing an insulated structure.

According to another aspect, a repeated-use maintenance portion defines an initial-use length and a reuse length. The initial-use length is longer than the reuse length.

According to yet another aspect, a sensor outwardly extends from a connector parallel with a second panel It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. An insulated structure for an appliance, comprising:
- a first panel;
- a second panel coupled to the first panel;
- an evacuation port defined by the second panel;
- a connector coupled to the second panel and disposed over the port;
- a servicing tube coupled to the connector and extending along the second panel, the servicing tube including an attachment end, a maintenance portion, and a stepped portion therebetween; and
- a sensor coupled to the connector.

2. The insulated structure of claim 1, wherein the sensor outwardly extends from the connector and is parallel with the second panel.

3. The insulated structure of claim 2, wherein the sensor is a pressure sensor configured to monitor the internal pressure of the insulated structure.

4. The insulated structure of claim 1, wherein the connector, the port, and the servicing tube define a servicing assembly, and wherein the servicing assembly is selectively covered by a cap.

5. The insulated structure of claim 1, wherein the attachment end is coupled to the connector adjacent to the second panel, and wherein the maintenance portion extends from the stepped portion parallel to the second panel to define a unique space.

6. The insulated structure of claim 1, wherein the connector is cylindrical and defines an aperture, and wherein the servicing tube is positioned within the aperture, and wherein the connector further defines a base coupled to the second panel and covering the port.

7. A vacuum insulated structure for an appliance, comprising:
- a liner;
- a wrapper coupled to the liner to form a structural enclosure;
- a port defined by the structural enclosure;
- a connector defining at least one aperture and coupled to the wrapper covering the port;
- a tube coupled to the connector and extending parallel to the structural enclosure, wherein the connector and the tube define a servicing assembly of the vacuum insulated structure; and
- a cap coupled to the structural enclosure, wherein the servicing assembly is selectively covered by the cap.

8. The vacuum insulated structure of claim 7, further including:
- a sensor, wherein the sensor is configured to detect a pressure change within the structural enclosure.

9. The vacuum insulated structure of claim 8, wherein the at least one aperture includes a first aperture and a second aperture, and wherein the sensor is disposed within the first aperture and the tube is positioned within the second aperture.

10. The vacuum insulated structure of claim 7, wherein the tube includes a repeated-use maintenance portion.

11. The vacuum insulated structure of claim 10, wherein the repeated-use maintenance portion defines an initial-use length and a reuse length, and wherein the initial-use length is longer than the reuse length.

12. An insulated structure, comprising:

a first panel;

a second panel coupled to the first panel, wherein the first and second panels define an insulating cavity therebetween;

a port defined by the second panel, wherein the port is an opening into the insulating cavity;

a connector coupled to the second panel; and a tube coupled to the connector and extending parallel along the second panel, wherein, the port, the connector, and the tube define a servicing assembly for the insulated structure, and wherein a cap selectively covers the servicing assembly.

13. The insulated structure of claim 12, wherein the tube includes an attachment end, a repeated-use maintenance portion, and a stepped portion therebetween, and wherein the stepped portion and the repeated-use maintenance portion define a unique space relative to the second panel.

14. The insulated structure of claim 12, wherein the tube includes a repeated-use maintenance portion for repeatedly sealing and unsealing the insulated structure.

15. The insulated structure of claim 14, wherein the repeated-use maintenance portion defines an initial-use length and a reuse length, wherein the initial-use length is longer than the reuse length.

16. The insulated structure of claim 12, further including:

a sensor outwardly extending from the connector parallel with the second panel.

* * * * *